United States Patent [19]

Fontaine

[11] 4,268,033

[45] May 19, 1981

[54] CUE BALL AIMING DEVICE

[76] Inventor: Paul E. Fontaine, 9411 Railton, Houston, Tex. 77080

[21] Appl. No.: 137,843

[22] Filed: Apr. 7, 1980

[51] Int. Cl.[3] ..... A63D 15/00

[52] U.S. Cl. ..... 273/2

[58] Field of Search ..... 273/2, 3 R, 3 A, 6, 273/14, 11, 203, 183 A; 35/29 R

[56] References Cited

U.S. PATENT DOCUMENTS

| | | | |
|---|---|---|---|
| 2,014,788 | 9/1935 | Strickler et al. | 273/2 |
| 3,220,122 | 11/1965 | Miller | 273/14 |
| 3,299,537 | 1/1967 | Franks | 273/14 |
| 3,389,911 | 6/1968 | Castiglione | 273/2 |
| 3,411,779 | 11/1968 | McGowan | 273/2 |
| 3,463,593 | 8/1969 | Horan | 273/14 |
| 3,704,887 | 12/1972 | Thornton | 273/14 |
| 3,711,091 | 1/1973 | Dixon | 273/2 |
| 4,027,883 | 6/1977 | Batori | 273/14 |
| 4,151,990 | 5/1979 | Josenhans | 273/2 |
| 4,178,694 | 12/1979 | Bonney | 273/14 |

FOREIGN PATENT DOCUMENTS

| | | | |
|---|---|---|---|
| 1706 | 3/1908 | United Kingdom | 273/2 |

*Primary Examiner*—Richard C. Pinkham
*Assistant Examiner*—T. Brown
*Attorney, Agent, or Firm*—Arnold, White & Durkee

[57] ABSTRACT

A cue ball aiming device, comprising a cue ball spotter, an object ball cradle, a center-to-center sight, and a support structure, is provided for aiming a cue ball with respect to an object ball. The cue ball aiming device may aid in improving one's skill in playing the game of billiards.

9 Claims, 3 Drawing Figures

FIG. 1
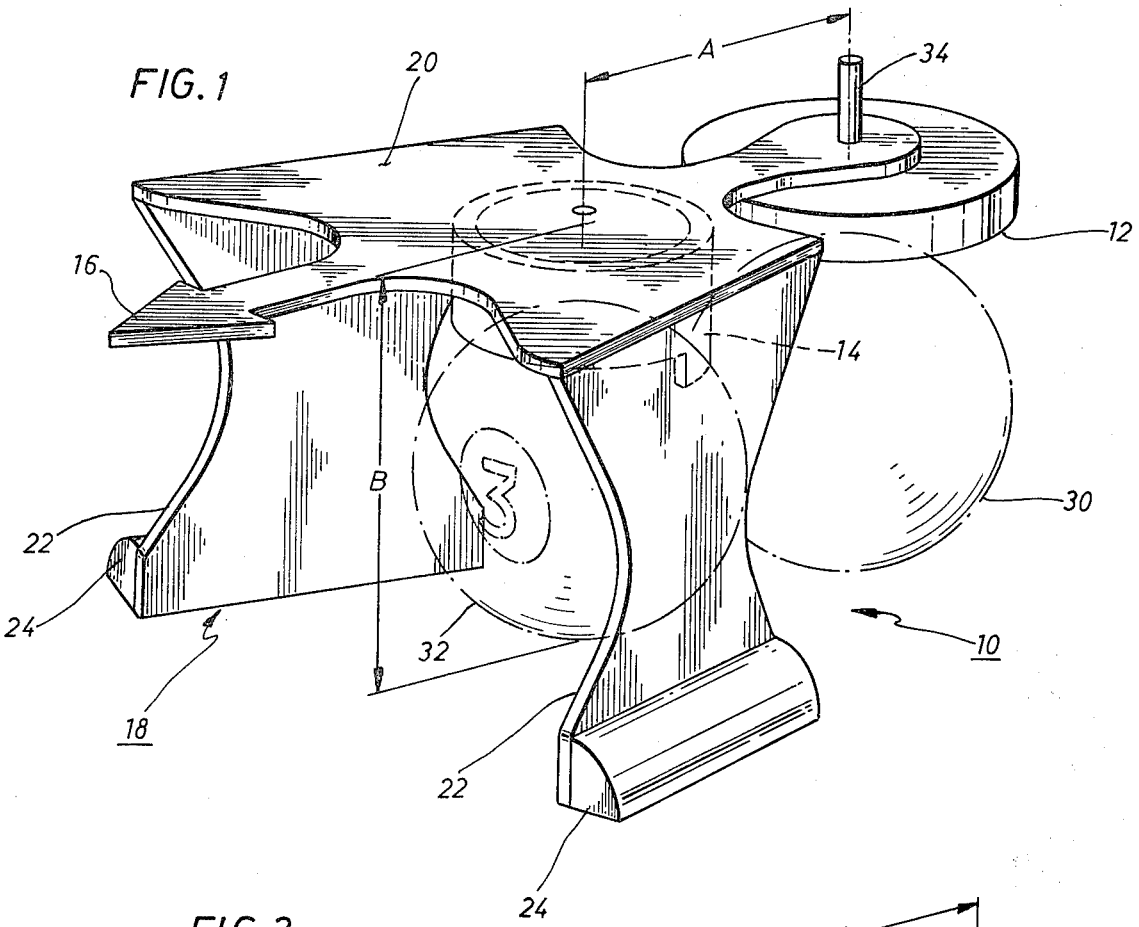
FIG. 3
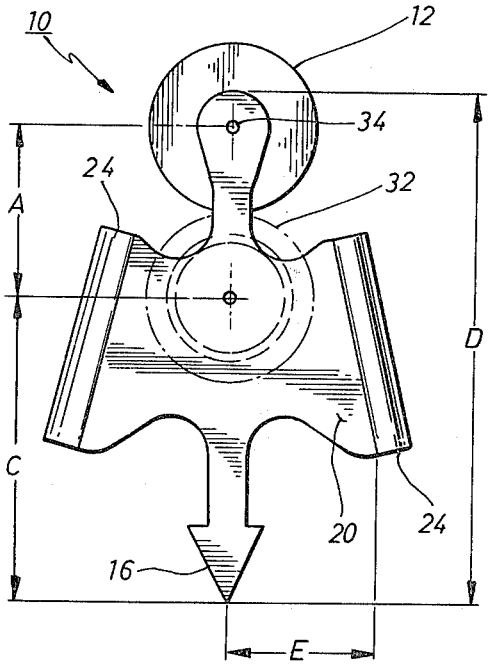
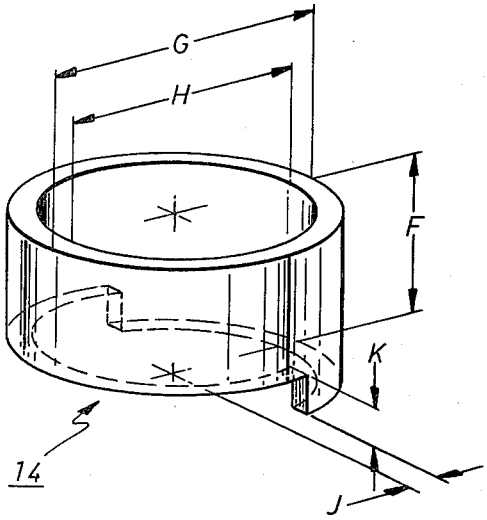
FIG. 2

CUE BALL AIMING DEVICE

BACKGROUND OF THE INVENTION

This invention relates generally to means for aiming a cue ball with respect to an object ball when practicing the game of billiards.

The game of billiards had its origin in Europe over 400 years ago. Today, the game of billiards has emerged into an exhaustive number of forms played throughout the world. There exist amateurs and professionals alike who spend countless numbers of hours mastering the skill required to become the best players of the game.

Pocket billiards, commonly called pool, has a large number of players, particularly amateurs, in the United States. A white cue ball and fifteen colored object balls are used, with the balls numbered from 1 to 8 being solid colors and the balls numbered 9 to 15 being striped. The fundamental object of pocket billiards is to stroke the cue ball with a cue stick such that the cue ball strikes the object ball at the appropriate point to pocket the object ball.

To master the game of billiards, it is necessary for a player to develop the skill of stroking the cue ball so that the cue ball strikes the object ball at the proper point of contact to project the object ball into a pocket. The cue ball aiming device of the present invention may aid a player in developing such skill.

By positioning the cue ball aiming device of the present invention over the object ball and aligning the cue ball aiming device with the appropriate pocket, a player is able to eye the path the cue ball must follow to properly strike the object ball. When the cue ball is aimed at the cue ball aiming device and stroked accordingly, the cue ball will strike the object ball at the proper point of contact and project the object ball into the appropriate pocket.

SUMMARY OF THE INVENTION

By means of the present invention, a cue ball aiming device is provided to aid in practicing the game of billiards. The cue ball aiming device of the present invention provides a means to improve one's skill in playing the game of billiards. To accomplish this, the cue ball aiming device comprises a cue ball spotter, an object ball cradle, a center-to-center sight, and a support structure, all of which may be integrally formed.

The cue ball aiming device is placed on the surface of a billiard table such that the object ball cradle abuts against a portion of an object ball. The cue ball aiming device is oriented around the object ball so that the center-to-center sight is aimed at the appropriate pocket. By shooting the cue ball directly under the cue ball spotter, the cue ball will make contact with the object ball at the exact point to cause the object ball to be projected into the appropriate pocket.

By using the present invention, one's skill at the game of billiards may be greatly improved. An exemplary embodiment of the present invention is shown in the appended drawings and described in the detailed description of the preferred embodiment.

BRIEF DESCRIPTION OF THE DRAWINGS

FIG. 1 is an isometric view of the preferred embodiment of the cue ball aiming device of the present invention. It depicts the cue ball aiming device in place as it appears just as the cue ball comes in contact with the object ball.

FIG. 2 is an isometric view of the preferred embodiment of the object ball cradle of the present invention.

FIG. 3 is a plan view of the preferred embodiment of the cue ball aiming device of the present invention.

DESCRIPTION OF THE PREFERRED EMBODIMENT

Referring to FIG. 1, the preferred embodiment of a cue ball aiming device 10 of the present invention is shown. The cue ball aiming device 10 comprises a cue ball spotter 12, an object ball cradle 14, a center-to-center sight 16, and a support structure 18 and is adapted to rest on the playing surface of a billiard table (not shown).

In the preferred embodiment, the support structure 18 comprises a substantially horizontally-positioned member 20 and two substantially vertical appendages 22, all of which may form an integral piece.

The cue ball spotter 12 and object ball cradle 14 are affixed to the horizontally-positioned member 20 which, at one end thereof, forms the center-to-center sight 16. Although the preferred embodiment of the present invention depicts the cue ball spotter 12, the object ball cradle 14, and the center-to-center sight 16 as three separate components, all three components may be formed as one continuous structure, within the contemplation of the present invention. In fact, in order to mass produce the cue ball aiming device, the entire device may be injection-molded as an integral piece.

The horizontally-positioned member 20 is supported by the two vertical appendages 22. The base of each vertical appendage 22, at the outside surface thereof, is connected to a foot 24. The appendage 22 and the foot 24 may form an integral piece. The feet 24 provide stability for the cue ball aiming device 10 and prevent it from tipping over. The substantially horizontally-positioned member 20 may be supported by any configuration of substantially vertical appendages, including four legs, and any such configuration is within the contemplation of the present invention.

Having described the major components of the cue ball aiming device 10 of the present invention, the important features of the cue ball spotter 12, the object ball cradle 14, and the center-to-center sight 16 are discussed.

In the preferred embodiment, the cue ball spotter 12 comprises a circular disc having a diameter substantially equal to that of a billiard ball. For example, the cue ball spotter 10 may have a diameter substantially equal to $2\frac{1}{4}''$. The circular disc may have any thickness, such as $\frac{1}{4}''$, as long as the distance between the bottom of the disc and the surface that the aiming device rests on is greater than the diameter of a ball, so that the cue ball may pass beneath the cue ball spotter.

Since the purpose of the cue ball spotter 12 is to provide a means for aiming a cue ball 30, any means which will accomplish this purpose may be provided and is within the contemplation of the present invention. For example, the cue ball spotter may comprise, but is not limited to, an elongated vertical cylinder, a replica of a cue ball, or a sight post such as that used on the end of a rifle.

One critical requirement of the cue ball spotter 12 is that the distance A between the centerline of the cue ball spotter 12 and the centerline of an object ball 32 when it is positioned against the object ball cradle 14 is substantially equal to the diameter of a ball, such as $2\frac{1}{4}''$.

The object ball 32 is shown in FIG. 1 abutted against the object ball cradle 14. An isometric view of the object ball cradle is shown in FIG. 2. The object ball cradle of the preferred embodiment has a generally tubular shape with an outside diameter G less than the diameter of the object ball 32. It is assumed for purposes of the present invention that the diameter of the object ball 32 and the diameter of the cue ball 30 are equal to $2\frac{1}{4}''$.

The object ball cradle 14 serves the important function of providing a means whereby the cue ball aiming device 10 may be properly positioned. The object ball cradle 14 is also designed so as not to obstruct the path of the object ball 32 as it is projected out from under the support structure 18.

The most critical feature of the object ball cradle 14 in the preferred embodiment is its height F (FIG. 2). The height F is dependent upon the thickness of the horizontally-positioned member 20, the outside diameter G of the object ball cradle 14, and the diameter of the object ball 32. By positioning the cue ball aiming device 10 over the object ball 32 so that the centerline of the object ball cradle 14 of the preferred embodiment and the centerline of the object ball 32 coincide, the height F of the object ball cradle 14 is determined so that the bottom of the object ball cradle 14 abuts against the object ball 32.

If the horizontally-positioned member 20 has a thickness of substantially 3/16", the cue ball aiming device 10 has a height B (FIG. 1) of substantially $3\frac{1}{8}''$, and the object ball cradle 14 has an outside diameter G of substantially 1-11/16" and an inside diameter H of substantially 1-19/32", the height F of the object ball cradle 14 will be substantially 15/16". As shown in FIG. 2, only a portion of the circumference of the object ball cradle 14 has a height F. In other words, a portion of the circumference of the object ball cradle 14 has a height equal to F minus K. The dimension K, such as $\frac{1}{4}''$, is determined to that the object ball cradle 14 does not obstruct the path of the object ball 32 as it is projected out from under the support structure 18.

To further prevent obstruction of the path of the object ball 32, the object ball cradle 14 has a height F minus K extending more than 180 degrees around its circumference. In the preferred embodiment, the dimension J is determined to be greater than $\frac{1}{4}''$.

Although the object ball cradle 14 of the preferred embodiment of the present invention has the characteristics described above, any means which would enable the proper positioning of the cue ball aiming device 10 over the object ball 32 is within the contemplation of the present invention. For example, the object ball cradle may comprise, but is not limited to, one or more substantially conical-shaped nodules extending out from the inside surface of each vertical appendage 22 to enable the proper positioning of the cue ball aiming device without obstructing the path of the object ball as it is projected out from under the support structure.

The center-to-center sight 16 (FIG. 1) forms one end of the horizontally-positioned member 20 and preferably has an arrowhead shape. The center-to-center sight serves the important function of providing a means whereby the cue ball aiming device 10 may be properly aligned along the appropriate path for the object ball 32 to follow.

The center-to-center sight 16 of the preferred embodiment is designed so that an imaginary line extending horizontally from the point of the arrowhead will intersect both of the imaginary centerlines extending vertically upward through the center of the object ball when it is properly positioned under the aiming device and the cue ball spotter 12. The size and shape of the center-to-center sight 16 is not significant, and any modification which would provide a means for aligning the cue ball locator 10 is within the contempation of the present invention. For example, the center-to-center sight may comprise, but is not limited to, a sight post such as that used on the end of a rifle.

A substantially cylindrical-shaped pin 34 (FIG. 1) extending vertically upward from the horizontally-positioned member 20 may be positioned anywhere along the aforementioned imaginary line extending horizontally from the point of the center-to-center sight 16 to aid in aligning the cue ball aiming device. In the preferred embodiment shown in FIG. 1, the pin 34 is positioned at the centerline of the cue ball spotter 12. Such positioning serves two functions: (1) the pin 34, as stated above, aids in properly aligning the cue ball aiming device; and (2) the pin 34 provides additional means for aiming the cue ball at the cue ball spotter 12. Although the pin 34 of the preferred embodiment has the characteristics described above, any means which would aid in properly aligning the cue ball aiming device is within the contemplation of the present invention. For example, the pin 34 may take the form of, but is not limited to, a substantially rectangular-shaped member forming a V-notch at its top.

As is shown in FIG. 1, the cue ball aiming device 10 has a height B greater than the diameter of a billiard ball. The distance of the height B is dependent upon the thickness of the material used and the diameter of a ball. In the preferred embodiment, the height B may typically be $3\frac{1}{8}''$.

Referring to FIG. 3, a plan view of the preferred embodiment of the cue ball aiming device 10 is shown. As is readily apparent, the distance between the inside surfaces of the feet 24 at the end of the cue ball aiming device 10 nearer the cue ball spotter 12 is greater than the diameter of the ball. As is also apparent, the distance between the inside surfaces of the feet 24 at the end of the cue ball aiming device 10 nearer the center-to-center sight 16 is greater than the distance between the inside surfaces of the feet 24 at the opposite end of the cue ball aiming device 10. In other words, the width of the horizontally-positioned member 20 gradually increases from rear (the end nearer the cue ball spotter 12) to front (the end nearer the center-to-center sight 16.)

As mentioned above, the only critical dimension shown in FIG. 3 is the distance A, which must be substantially equal to the diameter of a billiard ball. In the preferred embodiment, distance C may typically be 4"; distance D, $6\frac{5}{8}''$; and distance E, $2\frac{1}{4}''$.

The above discussion has been predicated on the fact that billiard balls have a diameter of $2\frac{1}{4}''$. It is within the contemplation of the present invention to provide a cue ball aiming device to accommodate any size of billiard balls.

Furthermore, it is to be understood that the invention will admit of other embodiments. The description of the preferred embodiment is given only to facilitate understanding of the invention by those skilled in the art and may not be construed as limiting the invention itself which is defined by the appended claims.

What is claimed is:

1. A cue ball aiming device, for aiming a cue ball with respect to an object ball, comprising:

a support structure adapted to rest on the playing surface of a billiard table and generally over an object ball, said support structure having at least two openings therein, the first of which openings being large enough to permit a cue ball to strike an object ball resting generally within the support structure and the second of which openings being large enough to permit the object ball to be projected out of said support structure;

a cue ball spotter for providing a means for aiming a cue ball, said cue ball spotter being affixed to the support structure at the end thereof nearer the first opening;

an object ball cradle against which an object ball may rest, to enable the proper positioning of support structure relative to an object ball and for providing an unobstructed path for the projection of an object ball through the second opening, said object ball cradle being affixed to and positioned within said support structure so that the distance between the centerline of the cue ball spotter and the centerline of an object ball when it is abutting said object ball cradle is equal to the diameter of a billiard ball; and a center-to-center sight for properly aligning the support structure, said center-to-center sight being affixed to the support structure and connected so that an imaginary line extending horizontally from the center of said sight intersects both of the imaginary centerlines extending vertically upward through the center of an object ball when it is properly positioned under the support structure and through the center of the cue ball spotter.

2. A cue ball aiming device of claim 1 wherein the support structure comprises a substantially horizontally-positioned member and at least two substantially vertical appendages connected to and supporting said substantially horizontally-positioned member.

3. A cue ball aiming device of claim 2 wherein the horizontally-positioned member has a width greater than the diameter of a billiard ball at the end nearer the first opening and a gradually increasing width extending toward the end nearer the second opening.

4. A cue ball aiming device of claim 2 wherein the horizontally-positioned member extends at one end into the center-to-center sight.

5. A cue ball aiming device of claim 1 wherein the cue ball spotter comprises a substantially horizontally-positioned circular disc having a diameter substantially equal to the diameter of a billiard ball.

6. A cue ball aiming device of claim 5 wherein the cue ball spotter comprises a substantially cylindrical-shaped pin extending vertically upward from the center of the circular disc.

7. A cue ball aiming device of claim 1 wherein the cue ball spotter comprises a substantially cylindrical-shaped pin.

8. A cue ball aiming device of claim 1 wherein the object ball cradle has a generally tubular shape.

9. A cue ball aiming device of claim 8 wherein the center-to-center sight has a substantially arrowhead shape.

* * * * *

UNITED STATES PATENT AND TRADEMARK OFFICE

CERTIFICATE OF CORRECTION

PATENT NO. : 4,268,033

DATED : May 19, 1981

INVENTOR(S) : Paul E. Fontaine

It is certified that error appears in the above-identified patent and that said Letters Patent are hereby corrected as shown below:

Col. 3, Line 41 - After "determined", "to" should read -- so --.

Col. 4, Line 10 - "contempation" should read -- contemplation --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*